United States Patent [19]

Baker et al.

[11] 4,295,839

[45] Oct. 20, 1981

[54] METHOD AND APPARATUS FOR FORMING A FLANGED TRAY

[75] Inventors: Thomas R. Baker; Peter C. Collura, both of Los Altos, Calif.

[73] Assignee: Kliklok Corporation, Greenwich, Conn.

[21] Appl. No.: 55,050

[22] Filed: Jul. 6, 1979

[51] Int. Cl.[3] ..... B31B 1/48

[52] U.S. Cl. ..... 493/143; 493/174; 493/408; 493/466

[58] Field of Search ..... 93/51 M, 51 HW, 51 R, 93/49 M, 49 R, 50, 47; 493/143, 167, 174, 408, 465, 466

[56] References Cited

U.S. PATENT DOCUMENTS

| | | | |
|---|---|---|---|
| 448,158 | 3/1891 | Munson | 93/51 R |
| 935,791 | 10/1909 | Jenkins | 93/51 R |
| 1,160,540 | 11/1915 | Smith et al. | 93/51 R |
| 1,534,569 | 4/1925 | Butterfield | 93/51 R |
| 1,965,274 | 7/1934 | Zanetti | 93/51 R |
| 2,398,200 | 4/1946 | Van Voorhis | 93/51 R |
| 2,925,758 | 2/1960 | Beetz | 93/51 R |
| 3,521,536 | 7/1970 | Waldbauer et al. | 93/51 HW |
| 3,618,481 | 11/1971 | Odenhagen | 93/51 R |

*Primary Examiner*—James F. Coan

*Attorney, Agent, or Firm*—Lowe, King, Price & Becker

[57] ABSTRACT

Method and apparatus for forming a stackable tray from a paperboard blank having a base panel, two pairs of wall panels attached to the base panel, adhesive coated gussets formed at the corners of the wall panels, and flanges formed along the outer edge of each wall panel. The tray forming apparatus includes a vertically reciprocating plunger having vacuum ports formed in its side walls, two pairs of flange folding fingers mounted on the plunger, a forming head including a cavity disposed beneath the plunger, and a stacking cage having flange retaining rails disposed beneath the cavity for receiving the trays after forming. The trays are formed as follows:

A tray blank is first positioned over the forming cavity. The downwardly reciprocating plunger contacts the blank and urges it into the cavity causing the tray sidewalls to be erected and the adhesive coated gusset corners to be folded against adjacent side walls. The erected tray walls are retained on the plunger by the vacuum ports. The flange folding fingers are actuated by linear cams, with first one pair of flanges being folded and then the other with the flanges being folded outwardly and downwardly with respect to the tray walls into an overbroken position until the flanges lie at an acute angle to the tray walls. At the bottom limit of the travel of the plunger, the formed tray is ejected into the stacking cage which is dimensioned to retain the flanges of the trays in the overbroken position and the tray is nested in the stack of previously formed trays so as to hold the gusset corners securely against the tray walls for a time sufficient to allow the adhesive to set. The folded flanges lend stiffness to the upper edges of the tray walls and allows the trays to be nested in the stacking cage. The flanged tray can be later sealed with a lid.

16 Claims, 19 Drawing Figures

Fig. 5
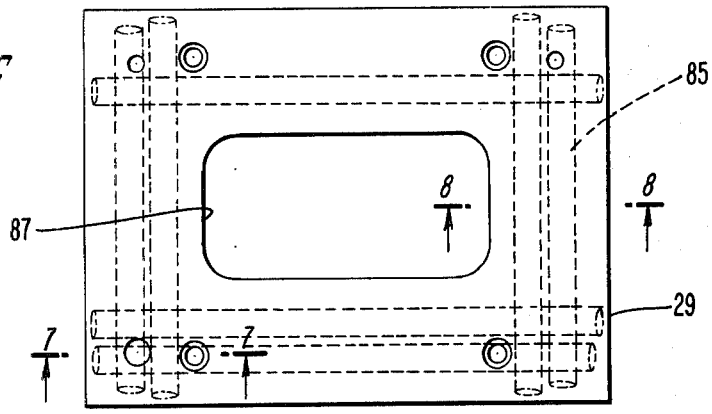
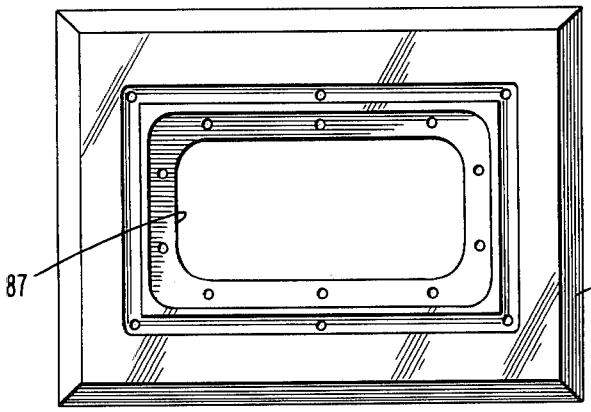
Fig. 6
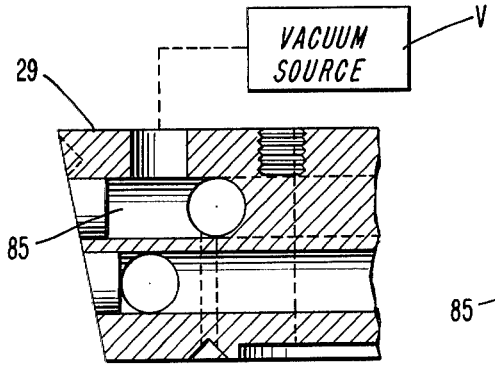
Fig. 7
Fig. 8
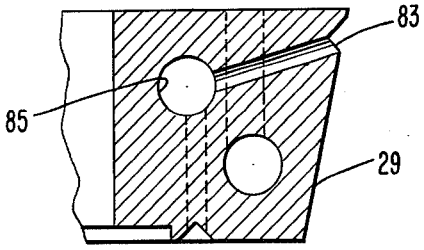

14
14
47
49
81
81
77
77
35
39
37
45
43
37
42
39
35
36
36
45
43
11
11
42
41
41
37
37
73
73
33
33
83
83
29
41
40
41

METHOD AND APPARATUS FOR FORMING A FLANGED TRAY

BACKGROUND OF THE INVENTION

The invention relates to the field of tray forming and more particularly to a method and apparatus for forming a stackable tray having reinforcement and sealing flanges around the top of the tray.

In the packaging art it has been common practice to form cartons and trays from coated paperboard or the like. An exemplary carton folding machine is shown in the patent to Baker et al., U.S. Pat. No. 2,655,843, issued Oct. 20, 1953 in which a vertically reciprocating plunger forces a paperboard blank into a die-forming cavity to erect the side walls of the carton and simultaneously join the corners.

Recently, with the increased popularity of packaged convenience foods, there has been a trend in the industry to provide a coated paperboard tray which can be placed directly in an oven (conventional or microwave) to heat the contents thereof and which can also be used as a serving tray for the food items after heating. This is becoming a very popular item for home use. Such an arrangement is also particularly advantageous when used in establishments where a large volume of food must be cooked and used within a short period of time such as the airline industry or in hospitals, since the food can be prepared ahead of time and frozen and then quickly reheated for serving. In addition, since the serving trays are disposable preparation and washing of dishes is eliminated.

The trays must be strong to prevent collapse during handling. Also, in order to keep the food warm after cooking, it is desirable to have some type of lid for the tray. Indeed, many foods must be cooked while sealed, in order to retain moisture and the flavor of the food.

One approach to provide a strong sealed tray is to form a flange of paperboard along the edges of the tray walls and provide a surface to which a cover can be sealed. The forming of a flanged, sealable tray, is a complex operation, since not only must the side walls of the tray be simultaneously erected and the corners glued, but the flanges must be overbroken; i.e., the flanges folded sufficiently to cause them to lie at approximately right angles to the tray wall when released.

The ends of the flanges preferably overlap slightly and may be adhesively bonded to create the secure, rigid "collar" around the upper edges of the tray walls. A lid is then sealed to the upper surfaces of the flanges.

The prior art machinery for forming such flanged, sealable trays is complex and operates quite slowly since not only must all the walls of the tray be quickly erected, but the tray must be secured in its erected position while the corner and flange adhesive sets. The paperboard blank is first forced into a die or cavity by means of a reciprocating plunger to erect the tray walls. The traydrops on to a conveyor or shelf and separate clamping means holds the tray in this position while the flanges are turned down. When the tray is in this position, it is held until the adhesive has sufficient time to set. Thus, there are serious limitations on throughput in present carton forming machines due to the necessity for separately forming the flanges and for retention of the carton in its erected position while the adhesive sets before the next carton blank can be handled.

It is thus an object of the invention to provide an improved method and apparatus for rapidly forming a stackable, flanged tray from a paperboard blank.

It is another object to provide the method and apparatus for forming a flanged tray which can be stacked immediately after forming.

It is yet a further object to provide a method and apparatus for forming a stackable, flanged tray in which the flanges are folded in an overbroken position with respect to the carton walls simultaneously with the forming of the tray itself.

It is an additional object to provide a method and apparatus for forming a flanged tray which is unusually strong and readily sealed after forming.

SUMMARY OF THE INVENTION

These and other objects are achieved by the present invention wherein there is provided an apparatus for forming a stackable tray from a paperboard blank having a base panel, two pairs of wall panels attached to the base panel, adhesive coated gussets formed at the corner of the wall panels, and flanges formed along the outer edge of each wall panel. The apparatus according to the present invention comprises a vertically reciprocating plunger having vacuum ports formed in the side walls thereof, two pairs of flange folding fingers mounted on the plunger, a forming head or die disposed beneath the plunger, and a stacking cage having flange retaining rails disposed beneath the cavity of the die for receiving the trays after forming.

In operation, a tray blank having adhesive applied to its gusset corners is positioned on the forming die. The downwardly reciprocating plunger contacts the base panel of the carton blank and urges the blank into the cavity of the forming die causing the tray side walls to be erected and the adhesive coated gussets to be folded against adjacent tray side walls. The erected tray walls are securely retained on the plunger by the vacuum ports during forming. The flange folding fingers are actuated by linear cams acting on cam followers mounted on the plunger in response to downard movement of the plunger through the forming cavity. Opposed first and second pairs of flanges are sequentially folded to avoid interference of adjacent flanges during the flange folding operation. The flanges are folded outwardly and downwardly with respect to the tray walls into an overbroken position until the flanges lie against or at an acute angle with respect to the tray walls. The vacuum securely holds the tray walls against the plunger At the bottom limit of the travel of the plunger the formed tray is ejected into the stacking cage which is dimensioned to retain the flanges of the tray in the overbroken position and the tray is nested in the stack of previously formed trays. The overbroken flanges bear against the gussets to securely hold the gussets against the tray walls for a time sufficient to allow the adhesive to set. The folded flanges lend stiffness to the upper edges of the tray walls and allow the trays to be nested in the stacking cage. The flanged tray can be later sealed.

The present invention has the advantage that tray forming, including flange folding, is performed while the paperboard blank is securely held on the plunger by means of the vacuum ports. This lends support and stiffness to the side walls of the tray while the flanges are being folded and increases reliability and accuracy of the folding process. Advantageously, the controlled overbreaking of the flanges with respect to the tray walls performed by the apparatus of the present invention insures that the flanges are disposed substantially perpendicular to the tray walls when the tray is released from the stacking cage due to the natural relaxation of the paperboard. Thus, there is no need for auxiliary apparatus to perform subsequent steps of folding the flanges perpendicular to the tray walls before sealing a lid thereto.

The flanges, when folded into their overbroken position, assist in retaining the adhesively joined gusset corners together to allow the adhesive to set, and allow the trays to be nested or stacked in the stacking cage immediately after forming, even though the adhesive applied to the gusset corner is not fully set. Thus, the number of trays which can be produced on the apparatus of the present invention depends solely on how rapidly a tray can be erected by the downwardly reciprocating plunger, rather than on the adhesive setting time as in prior art machinery. With increased throughput, the cost of producing a tray of the type described is considerably reduced. Besides being useful as a sealable tray for food items, a tray formed according to the principles of the present invention is useful for a wide variety of packaging situations where a sturdy and economical flanged tray, which can be sealed or left unlidded, is needed.

BRIEF DESCRIPTION OF THE DRAWING FIGURES

These and other features and advantages of the present invention are presented in the following detailed description taken in conjunction with the accompanying drawings wherein.

Figure 1:
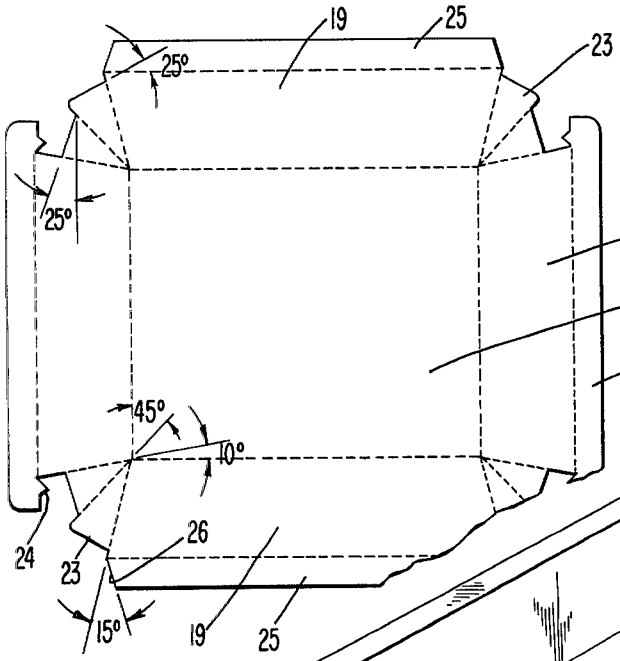
FIG. 1 is a plan view of a paperboard blank for a flanged tray.
Figure 4:
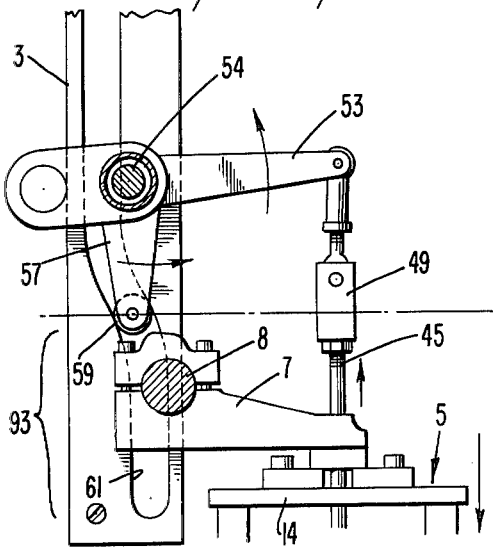
Figure 4A:
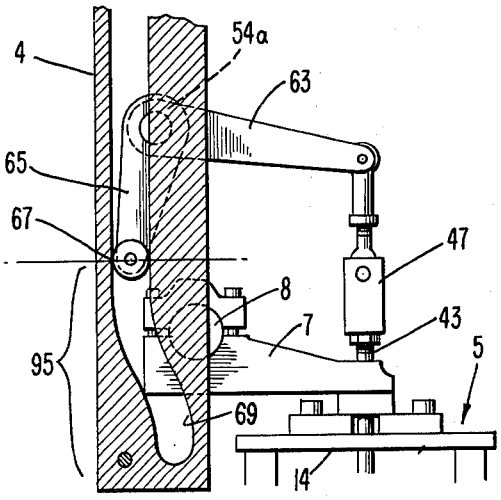
Figure 3:
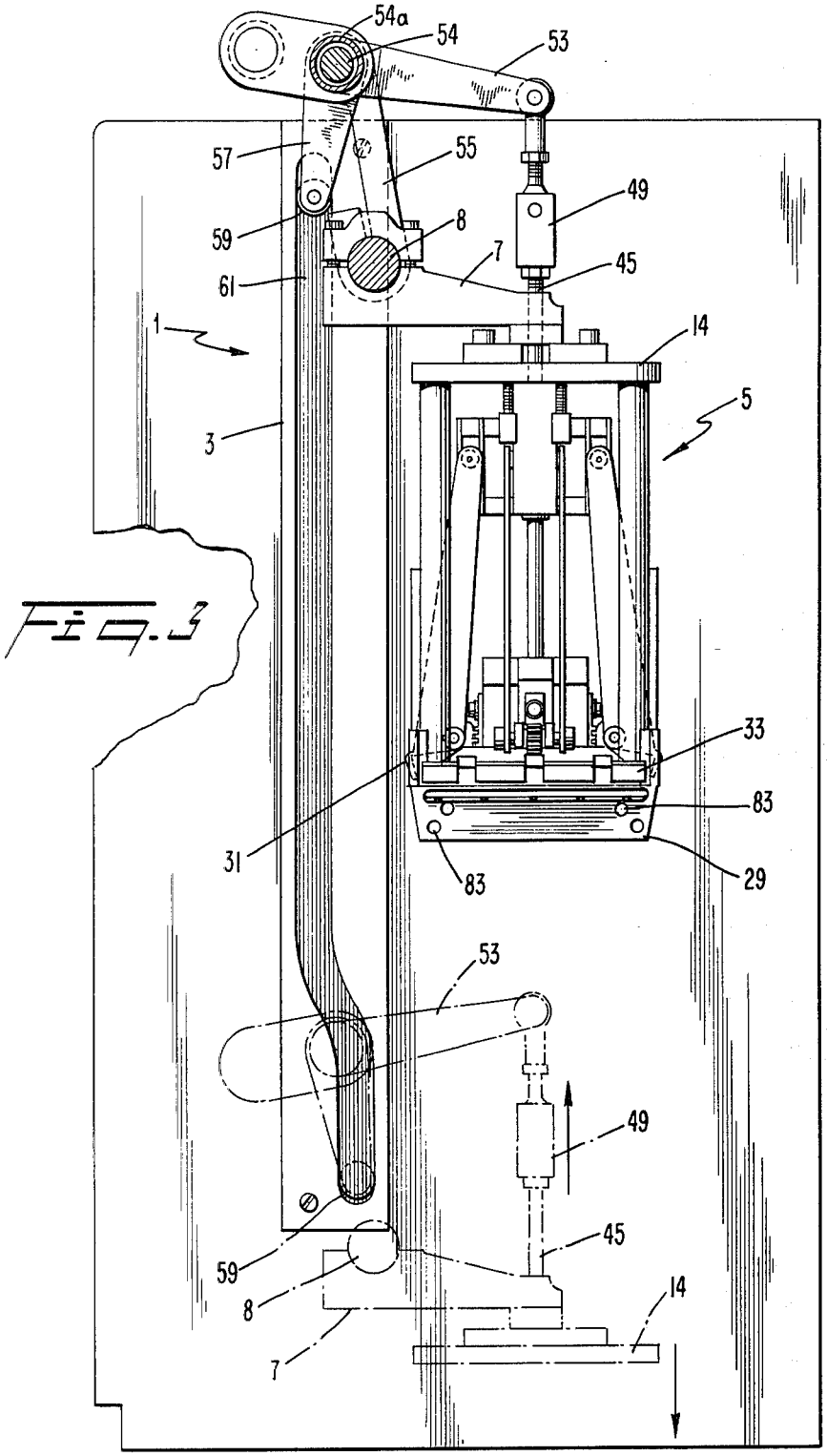
FIG. 3 is a side elevational view of the tray forming apparatus of the present invention.
Figure 9:
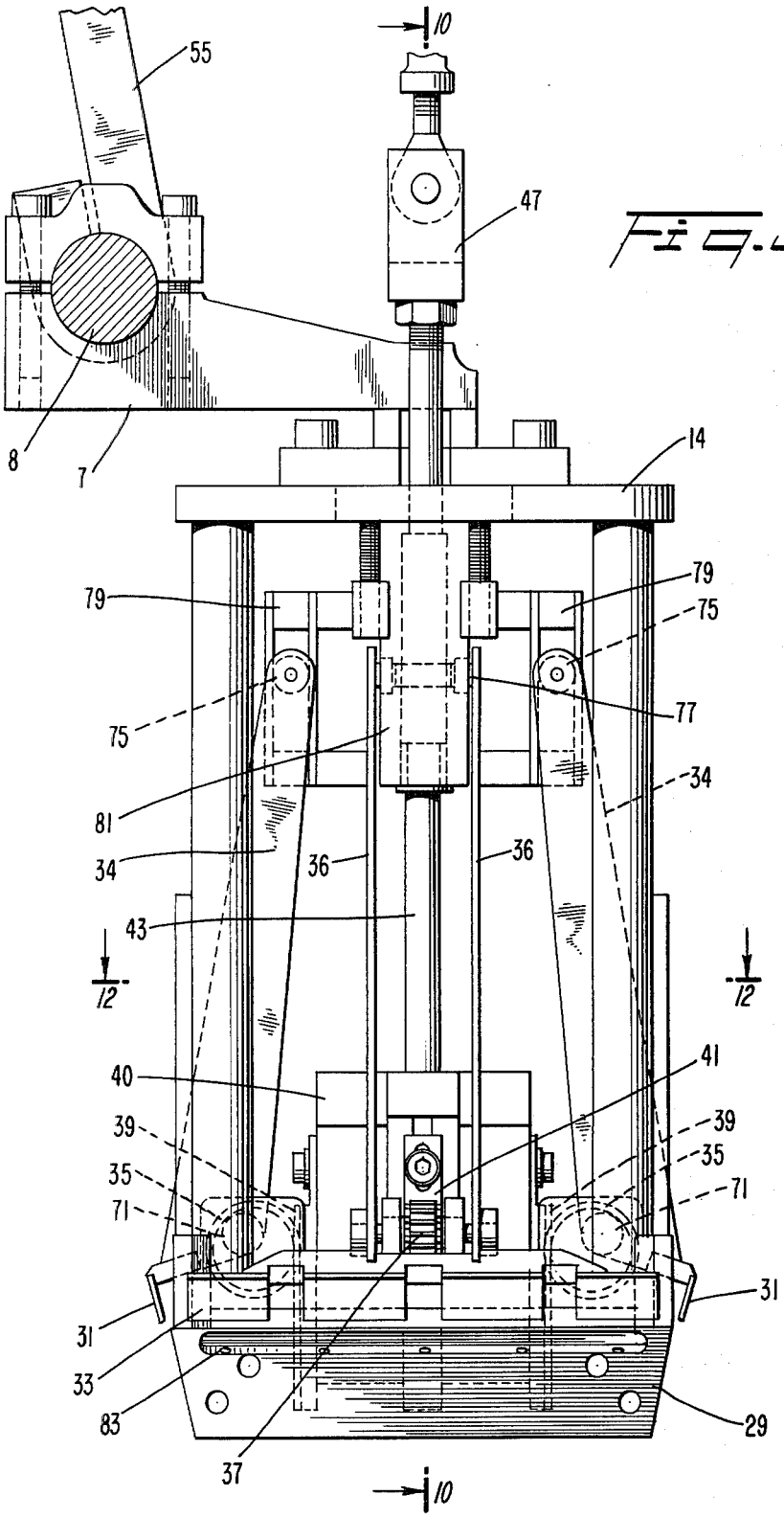
Figures 10, 11:
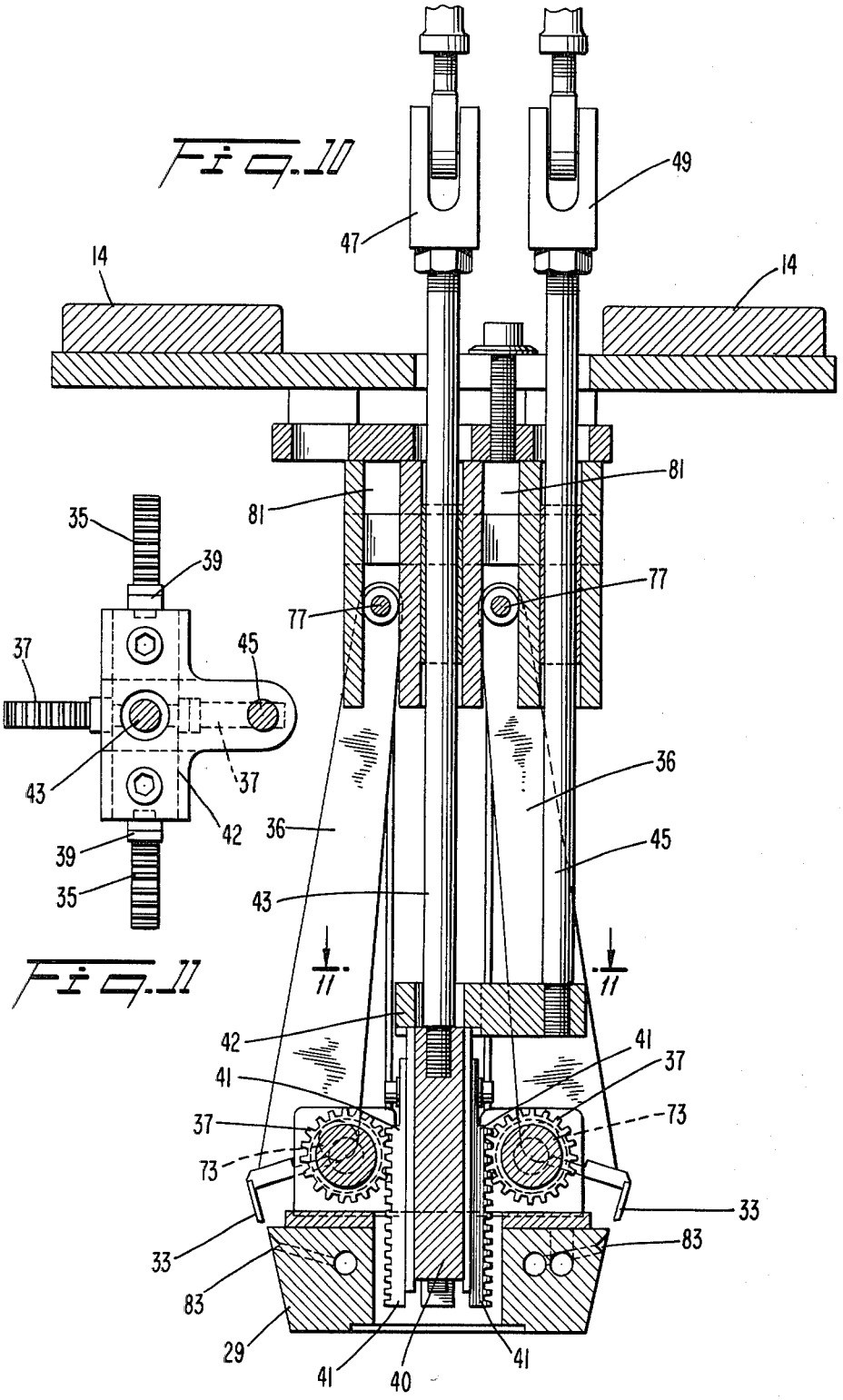
Figure 12:
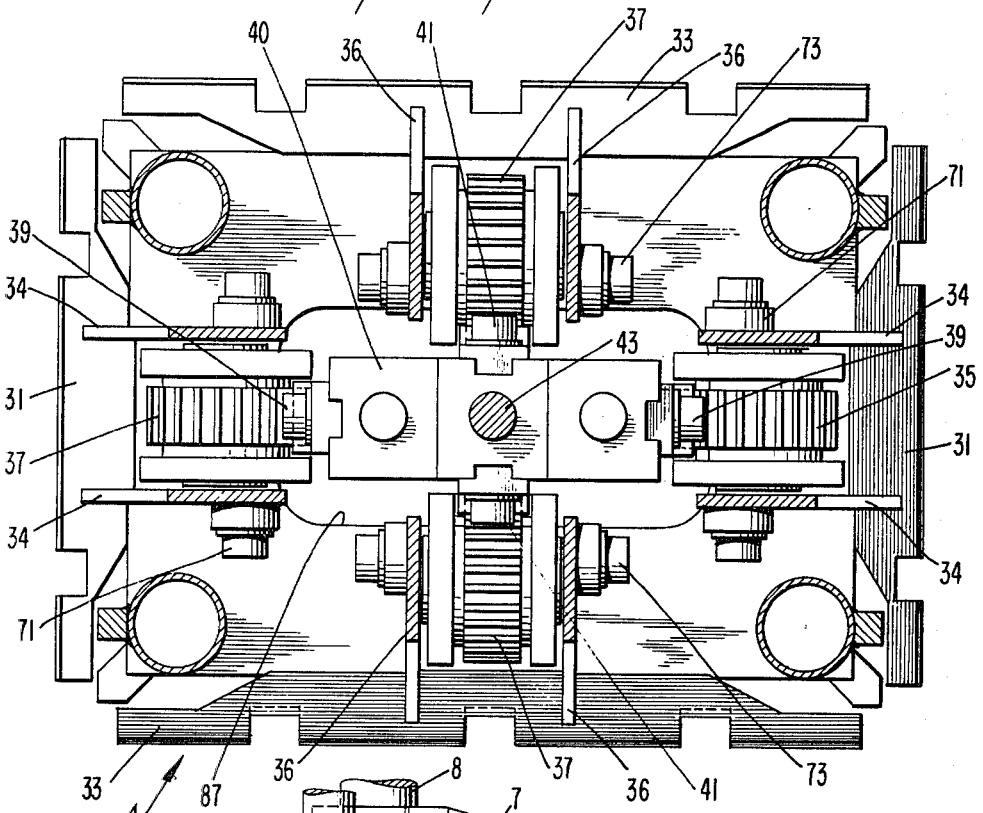
Figure 13:
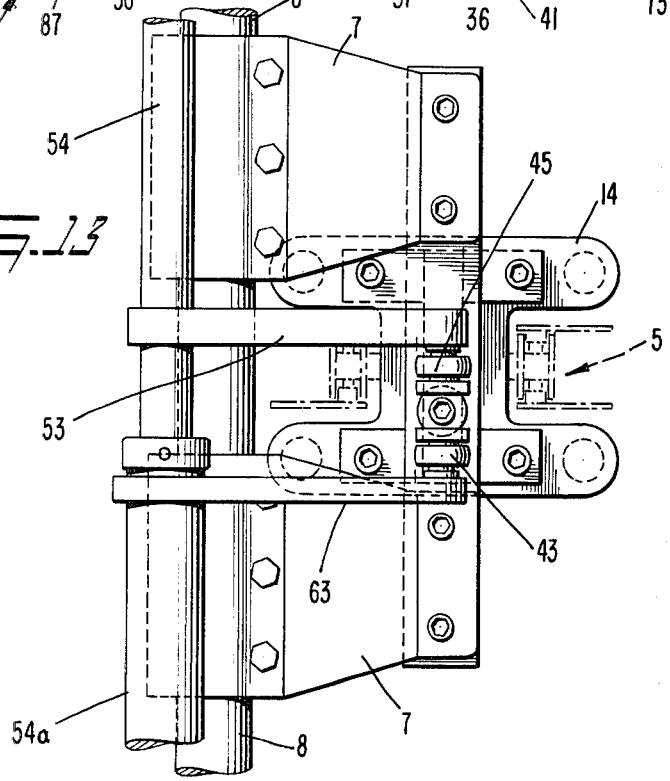

FIGS. 4 and 4*a* are detailed views of the plunger pushrod and actuator assemblies;

FIGS. 5 and 6 are respective top and bottom views of the plunger head;

FIGS. 7 and 8 are respective left side and front detailed sectional views of vacuum ports and channels of the plunger head shown in FIGS. 5 and 6;

FIG. 9 is a left side detailed view of the plunger assembly shown in FIG. 1;

FIG. 10 is a cross-sectional view of the plunger assembly taken on lines 10—10 of FIG. 9;

FIG. 11 is a cross-sectional view of the plunger assembly taken along lines 11—11 of FIG. 10;

FIG. 12 is a cross-sectional view of the plunger assembly taken along lines 12—12 of FIG. 9;

FIG. 13 is a detailed top view of the push rod actuator assemblies shown in FIGS. 3, 4, and 4*a;*

Figure 15:
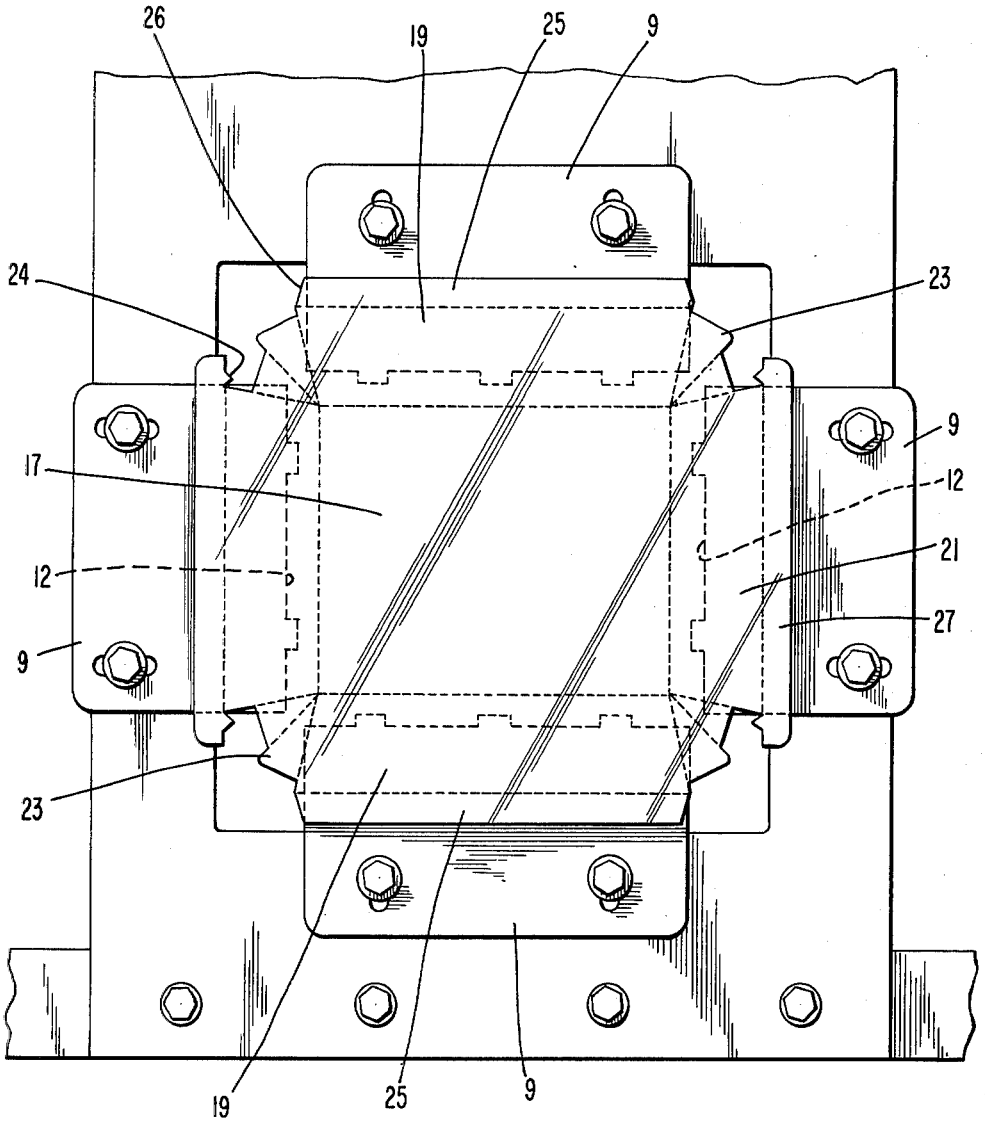

FIG. 14*a*, 14*b*, 14*c* and 14*d* are cross-sectional views of the plunger die and stacking cage, illustrating the various steps in forming, folding and stacking the flanged trays of the present invention;

FIG. 15 is a top view of the tray forming die showing the tray blank of FIG. 1 in a position for initial tray forming.

DESCRIPTION OF THE PREFERRED EMBODIMENT

Figure 2:
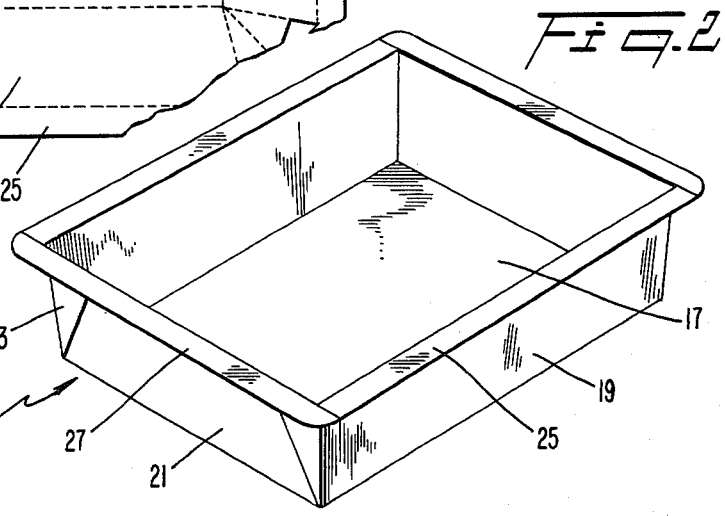
FIG. 2 is a perspective view showing an erected tray formed from the paperboard blank of FIG. 1.

A preferred type of flanged, rectangular tray 15 which is formed according to the method and apparatus of the present invention, is shown in FIGS. 1 and 2. The tray 15 is preferably formed from polyethylene coated paperboard stock, or the like, and includes a base panel 17, a pair of long wall panel 19, a pair of short wall panels 21, and four corner panels or gussets 23. Pairs of flanges 25 and 27 are respectively formed as the outer part of traywalls 19 or 21. Flanges 27 include projections 24 which hook around the corner under the end portions 26 of flanges 25 to assist in securing the corners and flanges together, when the tray is fully erected, even without adhesive. The flanges, wall panels, bottom panel and gussets are defined and separated from one another by fold lines shown as dashed lines in FIG. 1.

In order to form the paperboard blank into the completed tray 15 shown in FIG. 2, several steps must be taken. Prior to folding, a spot of adhesive, such as polyvinyl acetate, is applied, or the plastic coating is heat activated on a portion of each gusset 23. Wall panels 19 and 21 are erected and gussets 23 folded outwardly and then into contact with an adjacent wall panel so that the adhesive coated portions are in contact with the wall panels.

Flanges 25 and 27 are then folded outwardly so as to lie at approximately right angles to the tray walls. The outermost portions of long flanges 25 overlap the ends of short flanges 27. Adhesive may be applied to the overlapping portions to join the flanges together to form a rigid collar about the upper portion of the tray. The flanges lend rigidity to the tray and provide a surface to which a lid or other type of sealing material can be applied.

In folding the flanges 24, 27, the tray walls must be held securely in order to insure accurate, precise folding of the flanges. Another factor which must be taken into account when folding flanges 25, 27 is the inherent springiness of the paperboard stock from which tray 15 is formed. Some means should be provided to insure that the flanges will remain at right angles to the tray walls after folding. Otherwise, auxiliary apparatus would be needed to align the flanges before a lid could be sealed thereto.

The primary limitation on the "throughput" or number of cartons which can be formed per unit time on prior art machinery is the adhesive setting time during which the adhesive coated gussets must be held securely against the adjacent tray walls. If the tray is held on the carton erecting plunger while the adhesive sets, it is obvious this severely limits the number of cartons which can be erected, tray production can proceed no faster than the adhesive setting time.

The present invention provides the desired advantages and overcomes the problems to greatly increase the number of trays which can be produced in a given period of time. The flanges are folded into an overbroken position while the tray is securely held on a reciprocating plunger assembly and utilizing the overfolded flanges the gussets are held until the adhesive has set. The tray is then immediately ejected into a stacking cage which is dimensioned to hold the flanges in their folded, overbroken position, and thus assure the gussets remain in position while the adhesive sets. The stacking cage is arranged to allow a number of trays so formed to be nested one above the other. Thus, in the present invention, the speed of tray forming is limited solely by how rapidly the plunger assembly can be cycled in simple harmonic motion to erect the trays and fold the flanges.

In order to accomplish these results, a tray forming apparatus 1, shown in FIG. 3, comprises a vertical support 3 and a reciprocating plunger 5 attached to arm 7. Arm 7 is mounted to a horizontal shaft 8 which is arranged for vertical reciprocating harmonic motion by means of a motor driven timing wheel, such as shown in the aforementioned patent to Baker, U.S. Pat. No. 2,655,843.

As shown in more detail in FIG. 9, and in cross-section in FIGS. 10, 11 and 12, plunger assembly 5 includes a vacuum assisted plunger head 29, two pairs of identical tray flange folding fingers 31 and 33, two pairs of cam gears 35 and 37, respectively connected to the fingers 31 and 33 through folding arms 34 and 36, and two pairs of toothed racks 39 and 41, respectively in engagement with gears 35 and 37. Racks 39 are mounted on a yoke 40 which is connected to an actuator rod 43 which in turn is disposed vertically through openings provided in top plate 14 of plunger assembly 5, as best shown in FIG. 10.

Likewise, racks 41 are mounted on a yoke 42 which is connected to a second actuator push rod 45 also vertically disposed through openings in plunger assembly 5. The upper ends of actuator push rods 43 and 45 are connected through linkages 47 and 49, respectively, to actuator pivot arms 63 and 53 (FIGS. 3, 4 and **4*a*). Pivot arm 53, as shown in FIG. 4, is pivotally mounted to support 55 (FIG. 3) through shaft 54 which, in turn, is mounted to plunger assembly support arm 7 and shaft 8. Pivot arm 53 also includes a follower arm 57 having a journaled follower roller 59 captured within cam slot 61 formed vertically along a portion of side support 3**.

Actuator rod 43 is attached to pivot arm 63 through linkage 47 and is pivotally mounted to support 55 through shaft **54*a*, concentric with shaft 54. Pivot arm 63 includes a follower arm 65 having a journaled follower roller 67 riding in a second vertically aligned cam slot 69 formed within vertical support 4, as shown in FIG. 4*a*. The two cam slots, 61 and 69, have slightly different configurations so as to pivot arms 53 and 63** in a controlled timed manner relative to each other as will be described in more detail below.

With reference to FIGS. 9 and 10, opposed pairs of flange folding fingers 31 and 33 are respectively mounted (at 90° to each other) to a lower portion of folding arms 34 and 36. Folding arms 35 and 36 are respectively attached to shafts 71 and 73 which are journaled off-center through cam gears 35 and 37. The upper ends of arms 34 and 36 include journaled shafts 75 and 77 which ride in guides 79 and 81, respectively.

Plunger head 29, as shown in FIGS. 5 through 10, includes a number of vacuum ports 83 interconnected by passageways 85. Ports 83 take the form of an elongated slot and are formed around all four sides of plunger head 29. Passageways 85 are connected to a source of vacuum V. Plunger head 29 further includes a rectangular opening 87 (See FIGS. **14*a*–14*d*) which accommodates the reciprocating motion of the toothed racks 39, 41 and associated yokes 40, 42**.

Disposed immediately below the reciprocating plunger assembly 5 is a tray forming head or die 9. Die 9 includes a cavity 11 (See FIGS. **14*d* and 15) of sufficient size to accommodate plunger assembly 5 therein. A tray blank feeding mechanism (not shown), of a type conventional in the art, acts to sequentially feed tray blanks 15 into position directly over cavity 11 of die 9, as shown in FIG. 15. In its unfolded position, the tray blank covers the cavity 11. Die 9 forming the cavity 11 includes a number of upstanding posts 12 which which cause side walls of a tray blank 15 to be initially properly positioned and controlled. The fold lines of adhesive coated gussets are broken and the gussets folded against adjacent wall panels also by their respective posts 12 when the blank is forced into cavity 11 of die 9 by the downward motion of plunger assembly 5. The erected side walls of the tray after the initial movement into the top of the cavity are securely held to the plunger head 29 by the negative air pressure supplied through port 83. The continued downward motion of the plunger assembly utilizing the different cam slots 61, 69 (FIGS. 4, 4*a***) causes the flange folding fingers to be sequentially actuated and the tray flanges to be turned down.

The erected tray is then ejected from the bottom of cavity 11 and into a stacking cage 89, as shown in FIG. **14*d*, and forming another important aspect of the present invention. Stacking cage 89 is disposed directly beneath the forming die 9 to directly receive each tray as it is formed. It comprises a number of vertically disposed bar guides or rails 91. Stacking cage 89** is dimensioned to accommodate the erected trays while retaining the folded flanges in their overbroken, downturned position. In this manner, the folded flanges are held securely against adjacent tray side walls, and at an acute angle thereto, so as to bear against the adhesive coated gussets to secure the gussets into contacting engagement against the tray side walls while the adhesive bond therebetween has sufficient time to set.

Thus, to review the entire operation, a tray blank is fed by a feed mechanism (not shown) into alignment over the forming die 9 with bottom panel 17 directly over cavity 11 of the die (See FIG. 15). At this point, the plunger assembly is disposed at its uppermost limit of motion with respect to support 3 and the forming cavity, as shown in FIG. 3. The plunger assembly drive (not shown) causes shaft 8 carrying arm 7 and plunger assembly 5 to be moved vertically downward.

As the plunger assembly continues downward, plunger head 29 contacts base panel 17 of the tray blank and forces it first into cavity 11 of die 9. This section causes gussets 23 to begin to be formed through contact with posts 12 mounted adjacent die 9. As the tray blank is forced further into the die, side walls 19 and 21 of tray 15 are erected through contact with the walls of cavity 11. Negative air pressure is applied to ports 83 of plunger head 29 from vacuum source V (FIG. 7) to secure the erected tray side walls firmly to the plunger head as shown in FIG. **14*a***.

As the plunger assembly travels further downward follower roller 59 and 67 of follower arms 57 and 65 respectively riding in slots 61 and 69, enter respective arcuate areas 93 and 95, as shown in FIGS. 4 and **4*a*. As follower roller 59, attached to portion 57 of pivoting actuator arm 53, enters arcuate area 93 of slot 61 first, it is deflected first and causes arm 53 to pivot upwardly which draws actuator rod 45 upwardly, as shown in FIG. 4. Actuator rod 43 is similarly drawn upwardly next when journaled shaft 67 of pivoting actuator arm 63 enters shorter arcuate area 95 of cam slot 69**.

Thus, because of the different shapes and relative lengths of the arcuate areas 93 and 95 of slots 61 and 69, actuator rod 45 is drawn upwardly first during the machine cycle with actuator rod 43 being drawn upwardly subsequent to the upward movement of actuator rod 45. When the plunger assembly and support arm 7 are at their lowest downward position, both actuator arms 53 and 63 and respective actuator rods 45 and 43 are fully, upwardly extended. Slightly different arcuate paths followed by rollers 59 and 67 of follower arms 57 and 65 allows the sequential actuation of the first and second pairs of folding flange fingers 33, 31 which are respectively connected through gears 37, 35 and racks 41, 39 to actuator rods 43, 43 to be precisely timed. This advantageously avoids interference between the adjacent flanges 25, 27 and inward folding proceeds.

Figure 14A:
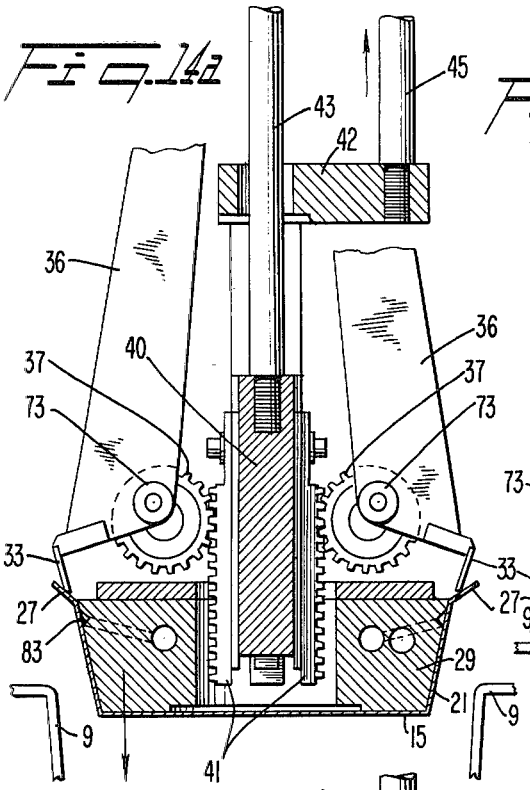
Figure 14B:
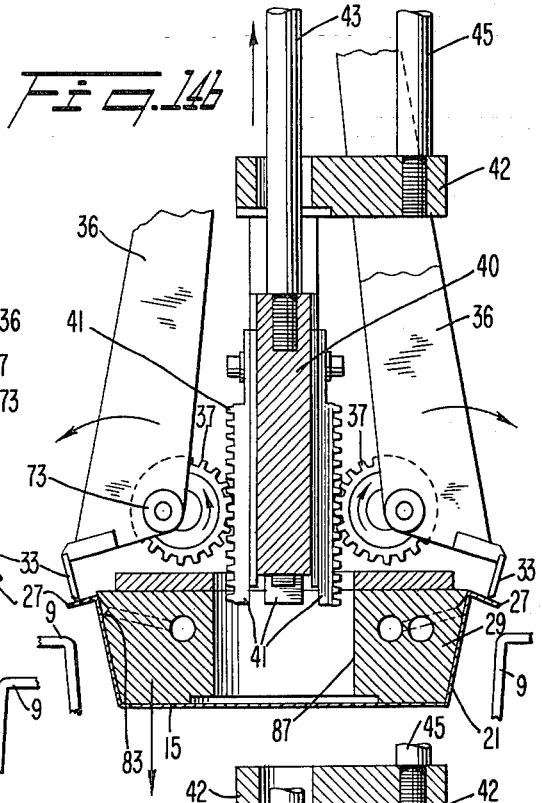

To understand the important flange folding process more completely, consider first the upward movement of actuator rod 45 causes toothed racks 41 to rotate cam gears 37 (FIG. 10). Rotation of gears 37 cause off-center mounted arms 36 to move outwardly with respect to plunger head 29 so that the first pair of flange folding fingers 33 contact the upper, inner edges of short flanges 27 of tray blank 15 to begin the flange folding process, as shown in FIG. 14*a*. Flange folding continues, as shown in FIG. 14*b*, with arms 36 and attached folding fingers 33 being moved to their outermost position with respect to the plunger head by continued rotation of cam gears 37. At this time, flanges 27 are disposed at approximately right angles to side walls 21 to tray blank 15.

Figure 14C:
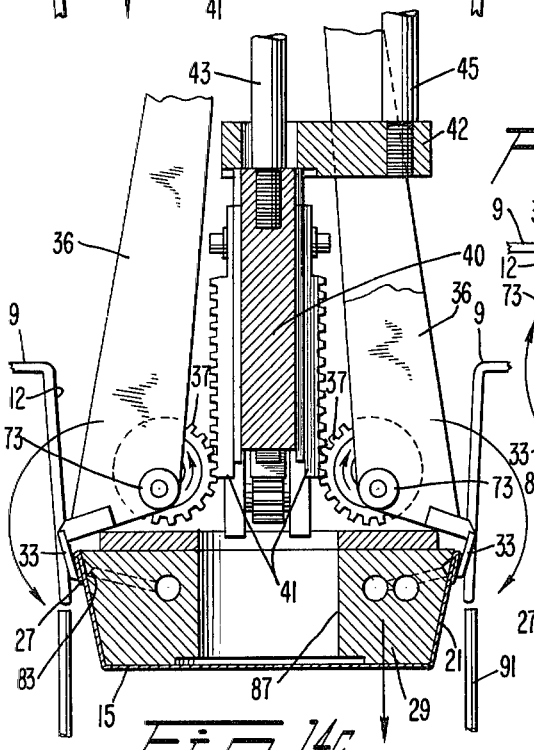
Figure 14D:
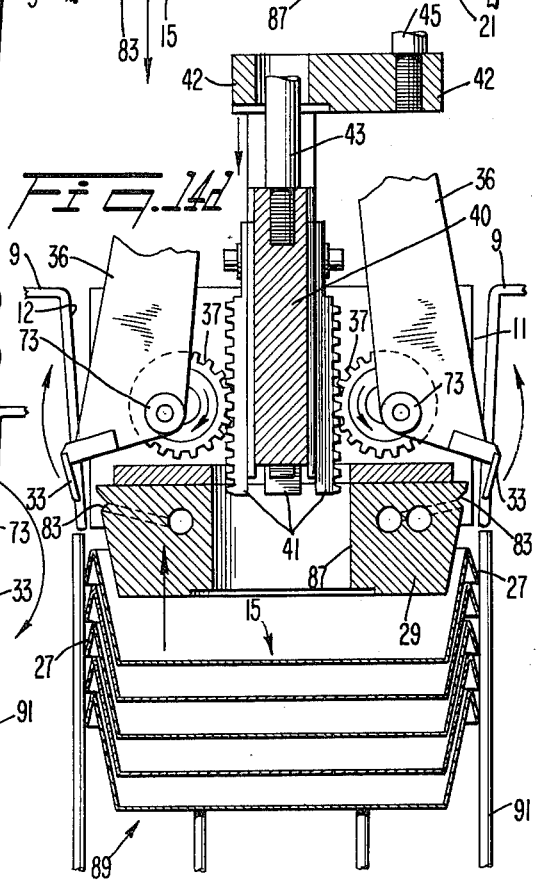

At approximately this time, follower roller 67 of actuator arm 63 enters arcuate portion 95 of slot 69 to initiate the upward motion of actuator rod 43. This causes the other pair of toothed racks 39 to be drawn upwardly and begin the similar actuation of folding fingers 31 for the remaining pair of flanges 25. The folding of flanges 27 is completed when actuator rod 45 is fully, upwardly extended as shown in FIG. 14*c*. At this time arms 36 are at their lowest point in travel due to the rotation of gears 37. Folding fingers 33 move inwardly towards plunger head 29 to overbreak flanges 27 to cause flanges 27 to contact tray side walls 21. Flanges 27 are held in this position by fingers 23 while plunger assembly 5 continues its downward movement through cavity 11. Similarly, the other pair of flanges 25 are folded downwardly by fingers 31 to contact side walls 19 of tray 15.

At this point, both pairs of flanges are securely held in their fully folded position by respective flange folding fingers 31 and 33 as plunger head 29 reaches its lowest point of reciprocating motion through cavity 11. It is to be noted that the sequential folding of first flanges 27 and then flanges 25 occurs as a continuous process while plunger head 29 moves through cavity 11 of die 9. Flanges 27 and 25 are sequentially folded so as to avoid interference of adjacent flanges with one another during the folding process. In addition, throughout the flange folding process, vacuum ports 83 securely hold the tray side walls to the sides of plunger head 29, thus providing a rigid surface from which the flanges can be accurately folded; first outwardly (FIG. 14*a*), then downwardly (FIG. 14*b*) and finally inwardly (FIG. 14*c*).

When flanges 27 are folded to lie flat against short side walls 21 of tray blank 15, flanges 27 also bear against previously folded gussets 23 to hold the adhesive coated surface of the gussets against tray side walls 21. This use of the folded tray flanges to secure the gussets, along with the ability of the apparatus to fold both pairs of flanges while the erected tray blank is carried on the plunger head through the tray forming die, constitute important features of the invention.

After reaching its lowest point of reciprocating motion, the plunger head 29, with the flanges still held in their overbroken position by the folding fingers, completely clears the lower portion of die 9. The plunger head enters the area defined by vertical guide rails 91 of stacking cage 89. As the plunger assembly 5 retracts upwardly by reciprocating support 7, the negative air pressure supplied to vacuum ports 83 is cut off to release the tray side walls. The upward motion of the plunger head causes the motions of the flange folding fingers, and associated actuating mechanisms to be reversed such that first folding fingers 31 are released from contact with flanges 25, followed by a release of fingers 33 from contact with flanges 27, with the plunger head in the position shown in FIG. 14*d*. The formed tray is released from contact with the plunger head. Because of the inherent resiliency or "springiness" of the paperboard stock from which the tray is formed, flanges 31 and 33 relax slightly to lie at an acute angle with respect to the tray side walls and will bear against guide rails 91 of stacking cage 89. The guide rails of the stacking cage are dimensioned so as to allow a small amount of outward relaxation of the tray flanges so that the trays can be stacked and nested, one above the other, after they are formed. In addition, the guide rails retain the tray flanges at a desirable acute angle so that the flanges continue to bear against the adhesive coated gussets.

The downwardly folded flanges 25, 27 thus acting to secure the adhesive coated gussets against adjacent tray side walls is an important feature of the present invention. This provides an advantage over previous stacking tray designs in that the adhesive sets while the entire tray is held securely within the stacking cage. Since the adhesive setting time occurs while the tray is held in the stacking cage, rather than on the reciprocating plunger head, the number of trays which can be formed in a given period of time depends solely on how quickly the trays are formed and the flanges folded, not on the adhesive setting time.

In addition, the apparatus of the present invention allows the completed trays to be stacked directly in a nested fashion after being formed on the reciprocating plunger assembly. After the adhesive has set, the trays are removed one by one from the stock in the stacking cage. Because of the resiliency of the paperboard, the folded flanges tend to relax into a position substantially perpendicular to the tray walls after the trays are removed from the stacking cage. Since the flanges naturally relax to a substantially perpendicular position with respect to the tray walls, no auxiliary apparatus is necessary to perform this step. Projections 24 of flanges 27 help secure the corners and the overlapping flanges 25, 27 to assure the flanges are held together at the ends. The flanges also lend rigidity to the side walls of the tray. A cover or sealing film can then be applied to the upper surface of the flanges.

In summary, the present invention allows many of the complex steps in forming a flanged tray which previously had to be formed in separate sections of a packaging machine and even on separate machines, to be rapidly and accurately performed on a single apparatus, including a tray forming plunger and die assembly, which receives the paperboard blank of a tray, erects the tray side walls and folds the tray gussets, secures the erected tray walls to the plunger head by vacuum means, sequentially folds the first and second pair of flanges of the erected tray at an angle greater than 90° into a overbroken position while still on the plunger head, and then ejects the formed tray into a stacking cage which receives and retains the nested trays with the flanges held in a downwardly folded position. The adhesive coated portions of the gussets are held in contact with adjacent tray side walls by the folded flanges while the tray is held in the stacking cage for a time sufficient for the adhesive to set. A tray formed according to the present invention, when released from the stacking cage, has its flanges disposed at approximately right angles to the tray walls so that a cover or other sealing material can be applied to the flanges without the need for further handling of the tray flanges.

While the method and apparatus of forming a flanged tray of the present invention has been described in considerable detail, it is understood that various changes and modifications may occur to persons of ordinary skill in the art without departing from the spirit and scope of the invention as defined in the appended claims.

We claim:

1. A method of forming a tray from a paperboard blank or the like having inherent resiliency, the tray including a base panel, two pairs of wall panels attached to the base panel, panels formed at the corners of the wall panels, and flanges formed along the outer edge of each wall panel, comprising the steps of:

providing adhesive on at least one of each adjacent wall panel and corner panel;

forming said tray wall panels into an erected position;

folding each said corner panel to contact an adjacent wall panel such that the adhesive is in the area of contact;

folding said flanges outwardly and downwardly from said erected tray wall panels into an overbroken position to lie in an acute angle with respect to said wall panels, said flanges being folded through an angle sufficient to overbreak the flanges with respect to said walls such that said folded flanges may relax to a raised, approximately horizontal position when said tray is released;

retaining said flanges against the resiliency of the blank in said overbroken position over and in contact with said corner panels to retain said panels in contact with the adjacent wall panels for a time sufficient to allow an adhesive bond to form therebetween; and releasing said tray to allow upward movement of the flanges to the raised position, whereby a tray is formed with a substantially continuous horizontal flange around the periphery thereof to allow sealing of a cover to the tray.

2. The method of claim 1 wherein a plurality of said trays are so formed said trays being nested one above another during said retention step, the folded flanges and the erected wall panels of said nested trays acting to secure the corners of adjacent trays.

3. The method of claim 1 wherein a first pair of opposing flanges is simultaneously folded and subsequently a second pair of opposing flanges is folded, all during said flange folding step so as to prevent interference of adjacent flanges with one another.

4. The method of claim 1 wherein said flanges are folded through an angle greater than 90° to lie at an acute angle with respect to and substantially flat against said wall panels.

5. The method of claim 2 wherein said trays are stacked vertically, the most recently formed tray being placed atop the stack of nested trays, said flanges having leading edges oriented in a downward direction.

6. Apparatus for forming a tray from a paperboard blank or the like, the tray including a base panel, two pairs of wall panels attached to the base panel, panels formed at the corners of the wall panels, an adhesive coating on at least one of each adjacent wall or corner panels, and flanges formed along the upper edge of each wall panel, comprising:

a support, a plunger assembly attached to said support and arranged for reciprocating vertical harmonic motion with respect to said support, said plunger assembly including a plunger head having vacuum ports arranged about said plunger head and connected to a source of negative air pressure;

a forming die disposed beneath said plunger assembly for receiving said paperboard blank along an upper surface thereof, said die including a cavity formed of sufficient size to allow free passage of said plunger assembly therethrough, whereby said tray wall panels are initially erected and said corner panels are folded into contacting engagement with adjacent wall panels of said tray as said reciprocating plunger contacts and forces said paperboard blank into said cavity, said erected walls being securely held to said plunger by said negative air pressure applied to said wall panels by said vacuum ports;

means for folding said tray flanges, comprising:

first and second pairs of flange folding fingers attached to said plunger assembly for folding said tray flanges;

a pair of cam gears each attached to one of said pairs of folding fingers for moving said fingers through an arc; and a pair of actuator rods connected to toothed racks in engagement with said gears and said support for sequentially moving said first and second pairs of flange folding fingers to cause said flanges of a tray held on said plunger head to be folded outwardly and downwardly with respect to said tray wall panels and in the direction of travel of said reciprocating plunger through an angle greater than 90° into an overbroken position so as to lie at an acute angle with respect to said tray wall panels; and means for receiving and retaining said erected and folded trays in a vertically stacked and nested arrangement comprising a plurality of vertically disposed, spaced-apart guide rails, said folded flanges being held in said overbroken position against said folded panels by said guide rails, whereby said adhesive coated panels are retained in contact for a time sufficient to allow an adhesive bond to form therebetween.

7. A method of forming a tray from a paperboard blank or the like, the tray including a base panel, two pairs of wall panels attached to the base panel, panels formed at the corners of the wall panel, an adhesive coating on at least one of each adjacent wall or corner panel, and overlapping flanges formed along the outer edge of each wall panel, comprising the steps of:

forming said tray wall panels into an erected position;

retaining said wall panels in said erected position by vacuum retaining means;

folding said corner into a contacting relationship with said adjacent wall panel to form a bond therebetween;

folding said flanges outwardly and downwardly from said erected tray wall panels through an angle greater than 90° into a overbroken position whereby said flanges are disposed at an acute angle with respect to said wall panels; all while said tray wall panels are retained by said vacuum retaining means;

releasing said erected tray from said vacuum retaining means;

stacking each of said trays so formed one above the other in a nested arrangement; and retaining said flanges of said stacked, nested trays in said overbroken position whereby said corner panels are retained in contact with adjacent wall panels for a time sufficient to allow an adhesive bond to form between said panels.

8. The method of claim 7 wherein a first pair of opposing flanges is simultaneously folded and subsequently a second pair of opposing flanges is folded, all during said flange folding step so as to prevent interference of adjacent flanges with one another.

9. The method of claim 7 further including the steps of releasing said stacked trays after said folding step to allow said flanges to relax to a position substantially perpendicular to said wall panels to allow sealing a cover to said flanges of said tray.

10. Apparatus for forming a tray from a paperboard blank or the like, the tray including a base panel, two pairs of wall panels attached to the base panel, panels formed at the corners of the wall panels, adhesive coating on at least one of each adjacent wall or cover panel, and flanges formed along the upper edge of each wall panel, comprising:

means for forming said tray wall panels into an erected position and for folding said corner panels into contacting engagement with adjacent wall panels of said tray, said forming means including vacuum retention means for retaining said wall panels in said erected position;

means, attached to said forming means, for folding said flanges outwardly and downwardly from said erected tray wall panels into an overbroken position to lie at an acute angle with respect to said wall panels;

means disposed beneath said forming means for retaining said erected and folded trays in a vertically stacked arrangement, said trays being nested within one another, and said folded flanges being held in said overbroken position by said retaining means against said folded gussets, whereby said corner panels are retained in contact with adjacent wall panels for a time sufficient to allow an adhesive bond to form therebetween.

11. The apparatus of claim 10 wherein said retaining means comprises a plurality of vertically disposed, spaced-apart guide rails for receiving said erected and folded trays.

12. The apparatus of claim 10 wherein said flange folding means includes means for folding a first pair of opposing flanges and subsequently folding a second pair of opposing flanges while said tray is held on said forming means.

13. The apparatus of claim 10 wherein said forming means is disposed directly above said tray retaining means.

14. The apparatus of claim 10 wherein said forming means comprises:

a support;

a plunger assembly attached to said support and arranged for reciprocating harmonic motion with respect to said support;

a forming die disposed between said plunger means and said tray retaining means, said die receiving said paperboard blank along an upper surface thereof, said die including a cavity formed of sufficient size to allow free passage of said plunger therethrough, whereby said tray wall panels are initially erected as said reciprocating plunger contacts and forces said paperboard blank into said cavity; and vacuum ports, arranged about said plunger and connected to a source of vacuum, said vacuum ports retaining said erected wall panels of said tray by means of the negative air pressure applied to said wall panels.

15. The apparatus of claim 10 wherein said means for folding said tray flanges comprises:

first and second pairs of folding fingers attached to said plunger;

cam means attached to said pair of folding fingers for moving said fingers through an arc;

actuator means connected to said cam means for actuating said first pair of folding fingers and subsequently said second pair of folding fingers, to cause said folding fingers to contact said flanges of said erected tray wall panels retained on said vacuum plunger and overbreak said flanges outwardly and downwardly with respect to said wall panels through an angle greater than 90° and in the direction of travel of said reciprocating plunger to cause said flanges to lie at an acute angle with respect to said wall panels.

16. The apparatus of claim 15 wherein said cam means comprises an off-center cam mounted on a gear and said actuator means comprises a toothed rack engaging said gear and actuator rods attached to said toothed rack for sequentially moving said first and second pairs of flange folding fingers to cause said flanges to be folded when said reciprocating plunger assembly is disposed near its lowest point of harmonic motion with respect to said support.

* * * * *